US006276624B1

(12) United States Patent
Endo et al.

(10) Patent No.: US 6,276,624 B1
(45) Date of Patent: Aug. 21, 2001

(54) CARBON FIBER PACKAGE AND CARBON FIBER PACKED MEMBER

(75) Inventors: Makoto Endo, Ehime; Haruki Morikawa, Shiga; Eiichi Yamamoto; Seiji Mizukami, both of Ehime, all of (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 09/117,495

(22) PCT Filed: Dec. 4, 1997

(86) PCT No.: PCT/JP97/04447

§ 371 Date: Aug. 28, 1998

§ 102(e) Date: Aug. 28, 1998

(87) PCT Pub. No.: WO98/24721

PCT Pub. Date: Jun. 11, 1998

(30) Foreign Application Priority Data

Dec. 5, 1996 (JP) ..... 8/340622

(51) Int. Cl.[7] ..... B65H 55/04

(52) U.S. Cl. ..... 242/174; 242/175; 242/176; 242/178

(58) Field of Search ..... 242/174, 175, 242/176, 177, 178

(56) References Cited

U.S. PATENT DOCUMENTS 4,544,113 * 10/1985 Yoshinaga et al. ..... 242/178
4,586,679 * 5/1986 Yamamoto et al. .
4,763,785 * 8/1988 Bradley et al. ..... 206/389
5,277,973 * 1/1994 Yamamura et al. .
5,489,067 * 2/1996 Nakai et al. .

FOREIGN PATENT DOCUMENTS 61-60570 * 3/1986 (JP) .
7-97138 * 4/1995 (JP) .

* cited by examiner

*Primary Examiner*—Donald P. Walsh
*Assistant Examiner*—Minh-Chau Pham
(74) *Attorney, Agent, or Firm*—Schnader Harrison Segal & Lewis LLP

(57) ABSTRACT

By using carbon fibers having a fineness of 25,000 deniers or more, the present invention provides a carbon fiber package including a cheese winding package or a coreless package in which an outside diameter of the package, a diameter of a bobbin or an inside diameter of the package, and a winding width are regulated in the specific ranges, a square-end type package in which a yarn width per fineness, wind angles at the start of winding and at the end of winding, and shifting of the yarn are regulated in the specific ranges, and a carbon fiber packed member in which an average bulk density is regulated in a specific range. Those carbon fiber packages and the carbon fiber packed member solve troubles and inconveniences during use, and also packages which have a high winding density and which do not break easily can be obtained.

8 Claims, No Drawings

CARBON FIBER PACKAGE AND CARBON FIBER PACKED MEMBER

TECHNICAL FIELD

The present invention relates to large packages and packed members of carbon fibers having particularly high fineness. Also, the present invention relates to packages of carbon fibers which are precisely formed into a desired shape with high winding density so as not to be easily broken, and to a method for producing the same.

BACKGROUND ART

There has been an increase in demand for the use of carbon fibers year by year, and the demand has been shifting from premium usage, such as for airplanes and sports equipment, to general industrial usage, such as for construction, civil engineering, and energy.

In general industrial usage, particularly in processes such as weaving, filament winding, pultrusion, and the like for forming large structural materials, a high fineness of approximately 100,000 deniers is required. Currently, in order to meet the demand described above, several yarns of approximately 7,000 to 20,000 deniers are combined to perform the formation.

Under the circumstances, if large packages having high fineness and heavy winding weight are obtained, the number of mountings of carbon fibers onto a higher processing apparatus will decrease and the creel unit will be more compact, and thus, great advantages are expected in the use of carbon fibers.

It is a first object of the present invention, in order to satisfy the demand described above, to provide a large package and a large packed member in which carbon fibers having particularly high fineness are wound so that the occurrence of trouble or inconvenience will be prevented during use.

On the other hand, with respect to the formation by combination, since there are distances between combination units, irregular impregnation of a resin may occur.

Also, since it is difficult to vertically layer fibers, fibers are horizontally combined, and thus, the thickness of the yarn will be the thickness of the combination unit, i.e., 7,000 to 20,000 deniers, and it is difficult to increase the thickness of the yarn. In particular, when a large and thick forming member is produced, the number of layers and the number of windings must be increased, resulting in disadvantage also in terms of formation time.

In other words, if a package of carbon fibers having a large number of filaments and large thickness is obtained, the number of mountings of carbon fibers onto a higher processing apparatus will decrease, formation time will be reduced, and the creel unit will be more compact, all of which are advantageous.

However, differing from general organic fibers, carbon fibers have significantly high Young's modulus and lack stretchability, and thereby, the range of windable tension is significantly small. If the tension is too low, trouble may easily occur, such as breaking at both sides of a roll, deformation due to external force, and slipping of a yarn layer out of a bobbin, and if the tension is too high, damage to yarns during winding, and deterioration of unwinding characteristics occur, and thus it has been technically difficult to set winding conditions with respect to cheese winding.

With regard to a carbon fiber package that does not easily break or does not have much fuzz during unwinding, a package has been disclosed in Japanese Patent Publication No. 62-46468, in which the package is a square-end type, and carbon fibers are taken up onto a bobbin with a given wind ratio, the wind angles of the fibers at the start of winding and at the end of winding are 10° to 30° and 4° to 12° respectively, and there is a shifting ratio of 50 to 150% of the average yarn width in relation to the already wound yarn, every 1 to 9 traverses. This package is a so-called "open-wind" package, in which, by minimizing the degree of overlapping of yarns, fuzz during unwinding and broken yarns are prevented. In the case of a bobbin having a given size, if the "open-wind" is used, as the yarns having a large number of yarns, that is, having high fineness, and having large thickness are wound, the spaces resulting from the overlap between yarns increase and the unevenness of the winding surface increases, and thus, the resultant package will be soft with low winding density, and both sides of the roll will easily bulge because the yarns are pushed out of the sides by means of winding tension and pressure on the winding surface (bearing pressure). Such a package may suffer broken winding during transportation, and because the bulge at both sides exceeds the length of a bobbin, the yarns may be damaged during the setup onto higher processing equipment.

It is the second object of the present invention, in view of the problems described above, to provide the most suitable shaped package with respect to winding of carbon fiber yarns having particularly high fineness, in which high winding density is obtained and breakage does not easily occur, by basically changing the form of winding.

DISCLOSURE OF INVENTION

A carbon fiber package as a first mode of the present invention includes a cheese winding package, in which a carbon fiber of *25,000* deniers or more is wound, and an outside diameter (D mm) of the package, a diameter of the bobbin (d mm), and a winding width (L mm) satisfy the following relationships:

$$d \geqq 50,$$

$$20 \leqq (D-d)/2 \leqq 400,$$

and $$0.05 \leqq (D-d)/2L \leqq 0.7$$

A carbon fiber package as a second mode of the present invention includes a coreless package, in which a carbon fiber having a fineness of 25,000 deniers or more is wound, and an outside diameter (D mm) of the package, an inside diameter (di mm) of the package, and a winding width (L mm) satisfy the following relationships:

$$di \geqq 50,$$

$$20 \leqq (D-di)/2 \leqq 400,$$

and $$0.05 \leqq (D-di)/2L \leqq 0.7$$

A carbon fiber package as a third mode of the present invention includes a square-end type package, in which a carbon fiber yarn having a fineness of 25,000 deniers or more is wound onto a bobbin such that a yarn width per fineness ranges from $0.15\times10^{\times3}$ to $0.8\times10^{\times3}$ mm/denier, wind angles at the start of winding and at the end of winding are in the ranges of 10° to 30° and 3° to 15°, respectively, and a fraction $W_0$ in a wind ratio W ranges from 0.12 to 0.88.

Also, in accordance with the present invention, a carbon fiber packed member is provided, in which a continuous carbon fiber having a fineness of 25,000 deniers or more is packed in a container with an average bulk density in a range of 0.03 to 1.2 g/cm$^3$.

BEST MODE FOR CARRYING OUT THE INVENTION

In carbon fiber packages in accordance with the first and the second modes of the present invention, preferably a winding density ranges from 0.8 to 1.2 g/cm$^3$. Herein, the winding density corresponds to "weight of wound carbon fiber/apparent volume of wound carbon fiber". Since the cheese winding package and the coreless package generally have a winding configuration in the shape of a doughnut-like cylinder, in the case of a cheese winding package, the apparent volume of wound carbon fiber is calculated as $\pi \cdot L(D^2-d^2)/4$, and in the case of an coreless package, it is calculated as $\pi \cdot L(D^2-di^2)/4$.

Also, preferably, carbon fibers to be wound are substantially non-twisted. If carbon fibers are twisted, it is difficult to wind up with high winding density, and also slacks may occur on the bobbin owing to uneven tension, resulting in entanglement, which is disadvantageous during unwinding. Herein, "substantially non-twisted" means that the number of twists is one turn or less per 1 m.

In carbon fiber packed members, preferably the carbon fibers to be packed are also substantially non-twisted.

There is no limitation to the properties of carbon fibers in accordance with the present invention. For example, tensile stress may range from 200 to 700 kgf/mm$^2$ and tensile modulus may range from 15 to 50 tf/mm$^2$.

In carbon fiber packages in accordance with the present invention, carbon fibers as described above are wound in the form of a cheese winding package or a coreless package, as a fiber bundle of thick carbon fibers having a fineness of 25,000 deniers or more, preferably of 30,000 deniers or more, and more preferably of 40,000 to 100,000 deniers. In such a fiber bundle of thick carbon fibers, the number of filaments is generally 27,000 or more, preferably 40,000 or more, and more preferably 55,000 to 150,000.

In the case of the cheese winding package, when a thick carbon fiber having a fineness of 25,000 deniers or more is wound into a package, if d is 50 mm or less in relation to the outside diameter (D mm) of the package, the diameter of the bobbin (d mm), and the winding width (L mm), the curvature of the carbon fiber in the innermost layer of the package decreases, and thereby, the fiber is drawn with tension during unwinding, breaks of the fiber easily occur, and trouble easily occurs during higher processing. Also, with respect to thick carbon fibers having a large number of filaments, since the fiber thickness increases, the trouble described above easily occurs. Also, since the wind angle increases during winding, unevenness easily occurs, which is also disadvantageous. On the other hand, if d is 200 mm or more, spaces within the bobbin diameter increase, and volumetric efficiency of a portion occupied by carbon fibers as a cheese winding package deteriorates.

Also, if the winding thickness, i.e., (D−d)/2, is 20 mm or less, being a large package becomes meaningless, and if it exceeds 400 mm, the package becomes too large and the weight increases too much, resulting in difficulty in handling.

Also, if a ratio of winding thickness to winding width, i.e., (D−d)/2L, is 0.05 or less, the volume of carbon fibers to be taken up decreases, and when securing the volume of carbon fibers to be taken up is attempted, the winding width increases extremely, which is disadvantageous in use. If (D−d)/2L is 0.7 or more, the wind angles at the ends increase and breaks easily occur. Consequently, in the carbon fiber package of cheese winding in accordance with the present invention, the following are the required ranges:

$$d \geqq 50, \text{ preferably, } 200 \geqq d \geqq 50,$$

$$20 \leqq (D-d)/2 \leqq 400, \text{ preferably, } 50 \leqq (D-d)/2 \leqq 400,$$

and $$0.05 \leqq (D-d)/2L \leqq 0.7$$

On the other hand, with respect to the coreless package, similarly, when forming a package by winding a carbon fiber having a fineness of 25,000 deniers or more, the outside diameter (D mm) of the package, the inside diameter (di mm) of the package, i.e., the diameter of a bobbin that is used to form the package and extracted after the package is formed, and the winding width (L mm) are set to satisfy the following relationships:

$$di \geqq 50, \text{ preferably, } 200 \geqq di \geqq 50,$$

$$20 \leqq (D-di)/2 \leqq 400,$$

preferably, $$50 \leqq (D-di)/2 \leqq 400,$$

and $$0.05 \leqq (D-di)/2L \leqq 0.7$$

Also, in the carbon fiber packed member in accordance with the present invention, a carbon fiber having a fineness of 25,000 deniers or more is packed in a container, for example, a carton case, with an average bulk density in a range of 0.03 to 1.2 g/cm$^3$, preferably 0.2 to 0.9 g/cm$^3$.

The bulk density is calculated by dividing the weight of the carbon fiber packed in the container by the apparent volume occupied with the carbon fiber. For example, when the carbon fiber is placed into a rectangular parallelepiped carton case, the bulk density is calculated by dividing the weight of the carbon fiber placed inside by the apparent volume calculated based on the height of the filled carbon fiber. Specifically, a method of producing a packed member having a bulk density of 0.03 to 1.2 g/cm$^3$ includes dropping carbon fibers from a fixed roll into a carton case placed on a mount having a traversing mechanism. The traversing mechanism may be movable so as to draw a sawtooth locus, or may move along the bottom face of the container. If the bulk density is below 0.03 g/cm$^3$, packaging efficiency deteriorates, and if the bulk density exceeds 1.2 g/cm$^3$, yarns are excessively pressed, resulting in unwinding failure during retrieval from the container.

As described above, with respect to the packed member form also, bulk containment is possible, and a significantly convenient form of thick carbon fibers can be provided for higher processing use.

In the third mode of a carbon fiber package in accordance with the present invention, preferably the wound yarn shifts from the yarn in the inner layer by 10 to 70% of the average yarn width every 1 to 9 traverses.

In accordance with the third mode of carbon fiber packages, a carbon fiber having a fineness of 25,000 deniers or more is taken up onto a bobbin such that the yarn width per fineness is in a range of $0.15\times10^{-3}$ to $0.8\times10^{-3}$ mm/denier in order to form a square-end type package, in which the wind angles at the start of winding and at the end of winding are in the ranges of 10° to 30° and 3° to 15° respectively, and a fraction $W_0$ in the wind ratio W is in a range of 0.12 to 0.88. In this method, it is also preferable that the yarn to be taken up be shifted every 1 to 9 traverses from the yarn already taken up at 10 to 70% of the average yarn width.

In accordance with the present invention, fineness of carbon fiber yarns is represented as single filament fineness (denier) x number of filaments. As described above, although any fineness is acceptable provided it is 25,000 deniers or more, since the single filament fineness is generally 0.2 to 0.9 denier so as to function well as a reinforcing fiber, the number of filaments is 28,000 or more.

The method for adjusting the fineness of the carbon fiber yarns to be taken up to 25,000 deniers or more includes a method of using an antecedent fiber having a high denier value as a starting material, a method of combining several antecedent fibers having a small number of filaments during the burning process by the time of completion of winding, and a method of retrieving carbon fibers which have been wound from a creel, and winding them while combining, however, the method is not limited to the above.

With regard to the method of regulating the yarn width in a range of $0.15\times10^{-3}$ to $0.8\times10^{-3}$ mm/denier, although there are no limitations, generally a method of bringing yarns into contact with a grooved roller, a fixed guide, or the like, a method of adding a sizing agent in order to prevent a single yarn from moving, and the like are combined. Also, the yarn width is represented as the mean between 5 points measured at distances of 10 m. In accordance with the present invention, since the carbon fiber yarns to be taken up have high denier values, it is substantially difficult to select a yarn having a width exceeding the above range.

The specific method for taking up the thick carbon fiber yarns having high denier values include, for example, setting a bobbin for taking up onto a take-up spindle of a winder, using, as a traverse guide, a plurality of free rotation rolls having an outside diameter of 5 to 30 mm placed in parallel which traverse parallel to the spindle axis, and winding up carbon fiber yarns through the traverse guide. In such a case, if the wind angle at the start of winding is less than 10°, particularly less than 5° (the wind angle at the end of winding is less than 3°, particularly less than 2°), breaks easily occur, resulting in damage to yarns. More preferably, the wind angle at the start of winding ranges from 12° to 17°, and the wind angle at the end of winding ranges from 4° to 7°.

When the carbon fiber yarns are taken up with a given wind ratio by means of the winder described above, it is preferable that yarns to be taken up uniformly extend onto the bobbin. The uniformity of positioning of yarns onto the bobbin is determined by a ratio of the number of revolutions by the bobbin to a traversing speed, i.e., a winding ratio. Specifically, the wind ratio W is represented by the following formula:

$$W=2L/(\pi D_0 \tan\theta),$$

wherein L is a stroke of the guide of the winder traversing substantially parallel to the bobbin, i.e., a traverse width (mm), $D_0$ is an outside diameter of the bobbin (mm), and θ is a wind angle at the start of winding.

If the wind ratio is an integer, the position of a yarn after one traverse completely overlaps the previous position of the yarn, if the wind ratio deviates from an integer, the position after one traverse shifts from the previous position of the yarn in response to the deviation. If the wind ratio is an integer, since a yarn continues to be taken up at the completely same position, yarns are localized, resulting in a non-uniform package with low winding density, which easily causes breaking of the roll. In order to uniformly place the yarn to be taken up onto the bobbin, a decimal fraction deviated from the integer, i.e., a fraction $W_0$ of the wind ratio W, is required to be in a range of 0.12 to 0.88. Within this range, the positions of the yarns can be thoroughly changed after each traverse, and thus, a package having high winding density can be formed. If $W_0$ is less than 0.12, or more than 0.88, because of it approaching an integer as described above, yarns are localized on the bobbin, resulting in an easily breakable package having low winding density.

Also, the yarns to be taken up onto the bobbin while being traversed overlap on the substantially same position after several traverses, and at this stage, the width of shifting of the upper yarn from the lower yarn (the yarn already taken up in the inner layer) is referred to as a shifting distance, and the ratio of the width to the lower yarn width is referred to as a shifting ratio. In the carbon fiber packages having high denier values and large thickness in accordance with the present invention, the shifting ratio is also important, and when the shifting ratio is more than 70%, the proportion of parts in which yarns do not overlap increases, and spaces are opened. The resultant package has low winding density, and thus, both sides may bulge because of tension and bearing pressure, both sides may be broken during winding, and even if winding is successfully completed to form a package, unwinding may occur during transportation. On the other hand, when the shifting ratio is less than 10%, the overlapping area between the upper and the lower yarns excessively increases, and thus, fuzz of upper and lower yarns may interfere, and fuzz and broken yarns may occur during unwinding because of adhesion of a sizing agent. A more preferable range of the shifting ratio is 20 to 50%.

When such high denier carbon fibers are taken up around a bobbin by means of a general winder, the shifting ratio is determined by the predetermined wind ratio and yarn width described above, and the determination is made in the same method as described in Japanese Patent Publication No. 62-46468.

EXAMPLES

The present invention will now be described with reference to more specific examples.

Example 1

A carbon fiber having 50,000 filaments (single yarn: 0.63 denier) and an areal weight (METSUKE) of 3.5 g/m was wound around a bobbin with a bobbin diameter of 80 mm at a winding width of 250 mm by means of a winder. The diameter D of the package was 400 mm, (D−d)/2 was 160, and (D−d)/2L was 0.64. Troubles such as off positions did not occur, and 30 kg of wound product was successfully produced. The carbon fiber package was mounted onto a creel of a filament winder, and unwound with a tensile force of 4 kg. Unwinding was completed without any trouble such as twining.

Comparative Example 1

A carbon fiber having 50,000 filaments (single yarn: 0.63 denier) and an areal weight (METSUKE) of 3.5 g/m was wound around a bobbin with a bobbin diameter of 30 mm at a winding width of 250 mm by means of a winder. Although troubles such as off position occurred with a probability of 10%, 30 kg of wound product was produced. The diameter D of the package was 500 mm, (D−d)/2 was 235, and (D−d)/2L was 0.94. The carbon fiber package was mounted onto a creel of a filament winder, and unwound with a tensile force of 4 kg. Partial yarn slacks occurred inside the yarns, and many void components were produced.

Example 2

A carbon fiber having 50,000 filaments (single yarn: 0.63 denier) and an areal weight (METSUKE) of 3.5 g/m, 20 kg by weight, was dropped from a height of 3 m into a carton case with a dimension of 400 mm×400 mm×400 mm which horizontally traverses so as to draw a locus of a square having a side of 250 mm with a center of the carton case as the intersection point of its diagonals in order to obtain a packed member. The tow was received without leaning. The height of the filled carbon fiber in the packed member was 160 mm, and the bulk density was 0.78 g/cm$^3$. The tow was raised from the carton case, and pultrusion process was performed with a pultruder. No trouble occurred during unwinding.

Comparative Example 2

A carbon fiber having 50,000 filaments (single yarn: 0.63 denier) and an areal weight (METSUKE) of 3.5 g/m, 20 kg by weight, was dropped from a height of 3 m into a carton case with a dimension of 400 mm×400 mm×400 mm which traverses the same way as in the example 2. During dropping, the tow was repeatedly pushed down to obtain a packed member. The height of the filled carbon fiber in the packed member was 90 mm, and the bulk density was 1.4 g/cm$^3$. The tow was raised from the carton case, and a pultrusion process was performed with a pultruder. The tow rose while being entangled with fuzz, and twined around the guide roll, and thereby, the process did not succeed.

Example 3

A carbon fiber having 50,000 filaments (single yarn: 0.63 denier) and an areal weight (METSUKE) of 3.5 g/m was wound around an extractable bobbin with a bobbin diameter of 80 mm at a winding width of 250 mm by means of a winder, and then the bobbin was extracted to form a coreless package. 30 kg of wound product was successfully produced without any trouble such as off positions. The diameter D of the package was 400 mm, di was 80 mm, (D/di)/2 was 160, and (D di)/2L was 0.64. The carbon fiber package was mounted onto a creel of a pultruder, and unwound from the innermost layer. Unwinding was completed without any trouble such as twining.

Comparative Example 3

A carbon fiber having 50,000 filaments (single yarn: 0.63 denier) and an areal weight (METSUKE) of 3.5 g/m was wound around an extractable bobbin with a bobbin diameter of 30 mm at a winding width of 250 mm by means of a winder, and then the bobbin was extracted to form a coreless package. Although troubles such as off positions occurred with a probability of 15%, 30 kg of wound product was produced. The diameter D of the package was 500 mm, (D−di)/2 was 235, and (D−di)/2L was 0.94. The carbon fiber package was mounted onto a creel of a pultruder, and unwound from the innermost layer. Partial yarn slacks occurred, and defects in resin impregnation occurred.

Example 4 (Levels 1 through 7), Comparative Example (Levels 8 and 9)

A carbon fiber yarn having a fineness of 31,500 deniers (number of filaments: 50,000) was wound onto a paper tube having an inside diameter of 82 mm and a length of 280 mm at a winding width of 250 mm to form a square-end type package. As shown in Tables 1 and 2, by changing the wind ratio, the shifting ratio was changed, and wound figures of the packages obtained, the winding density, and unwinding characteristics by side unwinding were investigated. The package obtained at the level 2 was excellent with respect to the wound figure and unwinding characteristics.

As is clear from the result of the example 4, if the requirements regulated in the present invention are met, (particularly, at the level 2, the fraction of the wind ratio), even if carbon fiber yarns have high fineness, packages having excellent winding density, wound figures, and unwinding characteristics can be obtained.

Example 5 (Levels 10 and 11)

A carbon fiber yarn having a fineness of 7,200 deniers (number of filaments: 12,000) was wound onto a paper tube having the same inside diameter and length as those in the example 1 while maintaining a winding width at 7 mm to form a square-end type package. As shown in Table 3, by changing the wind ratio, wound figures of the packages obtained, the winding density, and unwinding characteristics by side unwinding were investigated. All the packages obtained were inferior with respect to wound figures and unwinding characteristics.

TABLE 1

| | Level 1 | Level 2 | Level 3 |
|---|---|---|---|
| Fineness (denier) | 31,500 | 31,500 | 31,500 |
| Yarn width (mm) | 12 | 12 | 12 |
| shifting ratio/shifting distance (%/mm) | 4/0.5 | 24/2.9 | 96/11.6 |
| Wind angle (initial/final) | 13.2/5.5 | 13.2/5.5 | 24.3/10 |
| Wind ratio | 8.2522 | 8.2788 | 4.3000 |
| Traverse width (mm) | 250 | 250 | 250 |
| Outside diameter of bobbin (mm) | 82 | 82 | 82 |
| Final diameter of wound package (mm) | 192 | 194 | 202 |
| Winding density | 1.02 | 1.00 | 0.90 |
| Wound figure | Excellent | Excellent | Fair |
| Unwinding characteristics | Fair | Excellent | Fair |
| Winding weight (kg) | 6 | 6 | 6 |

TABLE 2

| | Level 4 | Level 5 | Level 6 | Level 7 | Level 8 | Level 9 |
|---|---|---|---|---|---|---|
| Fineness (denier) | 31,500 | 31,500 | 31,500 | 31,500 | 31,500 | 31,500 |
| Yarn width (mm) | 25 | 6 | 12 | 12 | 12 | 12 |
| shifting ratio/shifting distance (%/mm) | 12/2.9 | 48/2.9 | 37/4.4 | 39/4.7 | 31/3.7 | 30/3.6 |
| Wind angle (initial/final) | 13.2/5.5 | 13.2/5.5 | 12.4/5.5 | 12.4/5.5 | 13.5/5 | 12.3/5 |
| Wind ratio | 8.2788 | 8.2788 | 8.1548 | 8.8167 | 8.1045 | 8.8959 |
| Traverse width (mm) | 250 | 250 | 250 | 250 | 250 | 250 |
| Outside diameter of bobbin (mm) | 82 | 82 | 82 | 82 | 82 | 82 |
| Final diameter of wound package (mm) | 192 | 202 | 202 | 202 | 213 | 213 |
| Winding density | 1.02 | 0.90 | 0.90 | 0.90 | 0.80 | 0.80 |
| Wound figure | Excellent | Fair | Fair | Fair | Not good | Not good |
| Unwinding characteristics | Excellent | Fair | Fair | Fair | Not good | Not good |
| Winding weight (kg) | 6 | 6 | 6 | 6 | 6 | 6 |

TABLE 3

| | Level 10 | Level 11 |
|---|---|---|
| Fineness (denier) | 7,200 | 7,200 |
| Yarn width (mm) | 7 | 7 |
| shifting ratio/shifting distance (%/mm) | 53/3.7 | 51/3.6 |
| Wind angle (initial/final) | 13.5/5 | 12.3/5 |
| Wind ratio | 8.1045 | 8.8959 |
| Traverse width (mm) | 250 | 250 |
| Outside diameter of bobbin (mm) | 82 | 82 |
| Final diameter of wound package (mm) | 202 | 202 |
| Winding density | 0.90 | 0.90 |
| Wound figure | Fair | Fair |
| Unwinding characteristics | Fair | Fair |
| Winding weight (kg) | 6 | 6 |

INDUSTRIAL APPLICABILITY

In accordance with carbon fiber packages of the present invention, a carbon fiber having high fineness can be formed into a proper large cheese winding or a coreless package such that no trouble occurs during use, and the carbon fiber can be provided inexpensively and in a extremely convenient shape for the usage requiring thick carbon fibers.

Also, in accordance with carbon fiber packed members of the present invention, a carbon fiber having high fineness can be packed in a container in volume so that no trouble occurs during use, and similarly to the packages described above, carbon fibers can be provided inexpensively and in an extremely convenient shape for the usage requiring thick carbon fibers.

Also, in accordance with the present invention, a carbon fiber yarn having particularly high fineness can be wound into a desirable package which has high winding density, an excellent wound figure, and excellent unwinding characteristics and which is not easily broken.

What is claimed is:

1. A carbon fiber package comprising a cheese winding package comprising a carbon fiber of 25,000 deniers or more, wherein an outside diameter (D mm) of said package, a diameter of a bobbin (d mm), and a winding width (L mm) satisfy the following relationships:

$$d \geqq 50,$$

$$20 \leqq (D-d)/2 \leqq 400,$$

and $$0.05 \leqq (D-d)/2L \leqq 0.7.$$

2. A carbon fiber package comprising a coreless package comprising a carbon fiber having a fineness of 25,000 deniers or more, wherein an outside diameter (D mm) of said package, an inside diameter (di mm) of said package, and a winding width (L mm) satisfy the following relationships:

$$di \geqq 50,$$

$$20 \geqq (D-di)/2 \leqq 400,$$

and $$0.05 \leqq (D-di)/2L \leqq 0.7.$$

3. A carbon fiber package according to claim 1 or 2, wherein the winding density ranges from 0.8 to 1.2 g/cm$^3$.

4. A carbon fiber package comprising a square-end type package comprising a carbon fiber yarn having a fineness of 25,000 deniers or more, said carbon fiber yarn being wound onto a bobbin such that a yarn width per fineness ranges from $0.15\times10^{-3}$ to $0.8\times10^{-3}$ mm/denier, wherein wind angles at the start of winding and at the end of winding are in the ranges of 10° to 30° and 3° to 15°, respectively, and a fraction ($W_0$) in a wind ratio (W) ranges from 0.12 to 0.88.

5. A carbon fiber package according to claim 4, wherein the wound yarn shifts from the wound yarn in the inner layer by 10 to 70% of an average yarn width every 1 to 9 traverses.

6. A method for producing a carbon fiber package, comprising winding a carbon fiber yarn having a fineness of 25,000 deniers or more onto a bobbin such that a yarn width per fineness ranges from $0.15\times10^{-3}$ to $0.8\times10^{-3}$ mm/denier in order to form a square-end package, wherein wind angles at the start of winding and at the end of winding are in the ranges of 10° to 30° and 3° to 15°, respectively, and a fraction ($W_0$) in a wind ratio (W) ranges from 0.12 to 0.88.

7. A method for producing a carbon package according to claim 6, wherein the wound yarn shifts from the wound yarn in the inner layer by 10 to 70% of an average yarn width every 1 to 9 traverses.

8. A carbon fiber packed member comprising a continuous carbon fiber having a fineness of 25,000 deniers or more, said carbon fiber being packed in a container with an average bulk density in a range of 0.03 to 1.2 g/cm$^3$.

* * * * *

UNITED STATES PATENT AND TRADEMARK OFFICE

CERTIFICATE OF CORRECTION

PATENT NO. : 6,276,624 B1
DATED : August 21, 2001
INVENTOR(S) : Endo et al.

It is certified that error appears in the above-identified patent and that said Letters Patent is hereby corrected as shown below:

Column 10,
At approximately line 29, please change "$20 \geq (D\text{-}di)/f$" to -- $20 \leq (D\text{-}di)$ --.

Signed and Sealed this

Twelfth Day of March, 2002

*Attest:*

*Attesting Officer*

JAMES E. ROGAN
*Director of the United States Patent and Trademark Office*